US011339021B2

(12) United States Patent
Durner et al.

(10) Patent No.: US 11,339,021 B2
(45) Date of Patent: May 24, 2022

(54) DEVICE FOR WINDING AND CHANGING THE REELS OF WEB MATERIAL AS WELL AS A DEDICATED PROCESS

(71) Applicants: HOSOKAWA ALPINE Aktiengesellschaft, Augsburg (DE); HOSOKAWA KOLB GmbH, Niederkassel (DE)

(72) Inventors: Klaus Durner, Königsbrunn (DE); Manfred Göllner, Bobingen (DE); Lothar Klimek, Bobingen (DE); Jens Christian Kammer, Cologne (DE); Nicole Hoyer, Much (DE); Sebastian Westphal, Bonn (DE)

(73) Assignees: HOSOKAWA ALPINE Aktiengesellschaft, Augsburg (DE); HOSOKAWA KOLB GmbH, Niederkassel (DE)

( * ) Notice: Subject to any disclaimer, the term of this patent is extended or adjusted under 35 U.S.C. 154(b) by 277 days.

(21) Appl. No.: 16/709,025

(22) Filed: Dec. 10, 2019

(65) Prior Publication Data

US 2020/0180890 A1 Jun. 11, 2020

(30) Foreign Application Priority Data

Dec. 11, 2018 (DE) ..... 102018009632.8

(51) Int. Cl.
*B65H 19/26* (2006.01)
*B65H 18/10* (2006.01)

(52) U.S. Cl.
CPC ..... *B65H 19/26* (2013.01); *B65H 18/10* (2013.01)

(58) Field of Classification Search
CPC ..... B65H 19/22; B65H 19/26; B65H 19/30; B65H 19/223; B65H 19/2207; B65H 18/10
See application file for complete search history.

(56) References Cited

U.S. PATENT DOCUMENTS 2,206,981 A 7/1940 Sturtevant
3,770,124 A 11/1973 Frangquist
(Continued)

FOREIGN PATENT DOCUMENTS

AT 304 058 B 12/1972
BR 102019026088 A2 7/2020
(Continued)

OTHER PUBLICATIONS

For U.S. Appl. No. 16/600,260 Office Action dated Oct. 4, 2021.
(Continued)

*Primary Examiner* — Sang K Kim
(74) *Attorney, Agent, or Firm* — Paul D. Bianco; Gary S. Winer; Fleit Intellectual Property Law

(57) ABSTRACT

A device for winding and changing reels of web material includes two independently operable central drives for shifting winding shafts, a drivable winding shaft guide, a contact roller unit and slitting units. Both right-hand winding and left-hand winding are realized, whereby the device is without a prewinding station. For a winding shaft change, the drivable winding shaft guide is driven from the winding position into the parking position and is disconnected. Subsequently, the second central drive is connected to the winding shaft guide and is driven from its parking position into the winding position where the second central drive is connected with a new winding shaft. The contact roller unit
(Continued)

is driven against the winding shaft and the web material is cut through by a slitting device and then wound to a new reel.

13 Claims, 3 Drawing Sheets

(56) References Cited

U.S. PATENT DOCUMENTS

| | | | | |
|---|---|---|---|---|
| 3,809,515 | A | 5/1974 | Farrell | |
| 3,962,023 | A | 6/1976 | Hofer | |
| 4,018,388 | A | 4/1977 | Andrews | |
| 4,080,143 | A | 3/1978 | Upmeier | |
| 4,133,488 | A | 1/1979 | Heinemann | |
| 4,165,356 | A | 8/1979 | Heider | |
| 4,602,743 | A | 7/1986 | Nied | |
| RE33,085 | E | 10/1989 | Petersen | |
| 5,076,776 | A | 12/1991 | Kamada et al. | |
| 5,120,431 | A | 6/1992 | Cordonnier | |
| 5,370,327 | A * | 12/1994 | Adamski | B65H 18/26 242/533.1 |
| 5,377,843 | A | 1/1995 | Schumacher | |
| 5,377,931 | A | 1/1995 | Dorfel | |
| 5,505,601 | A | 4/1996 | Sensen et al. | |
| 5,544,841 | A * | 8/1996 | Didier | B65H 19/2253 242/541.1 |
| 5,673,870 | A * | 10/1997 | Fielding | B65H 19/2207 242/532.2 |
| 5,716,650 | A | 2/1998 | Marridis | |
| 5,735,481 | A | 4/1998 | Loosen | |
| 5,769,352 | A | 6/1998 | Biagiotti | |
| 5,967,449 | A * | 10/1999 | Thomas | B65H 18/26 242/541.1 |
| 5,992,773 | A | 11/1999 | Schwechten | |
| 6,169,122 | B1 | 1/2001 | Blizard | |
| 6,189,821 | B1 | 2/2001 | James | |
| 6,260,766 | B1 | 7/2001 | Ueyama | |
| 6,398,139 | B1 | 6/2002 | Nied | |
| 6,413,595 | B1 | 7/2002 | Schirmer | |
| 6,543,710 | B2 | 4/2003 | Hosokawa | |
| 6,783,344 | B1 | 8/2004 | Rudolf | |
| 6,964,394 | B1 * | 11/2005 | Raty | B65H 19/2261 242/541 |
| 7,028,931 | B2 | 4/2006 | Lin | |
| 7,036,763 | B2 | 5/2006 | Böhm et al. | |
| 7,255,301 | B2 * | 8/2007 | Schmidt-Hebbel | B65H 19/2261 242/533 |
| 7,481,390 | B2 | 1/2009 | Reinhold | |
| 7,811,073 | B2 | 10/2010 | Mahler et al. | |
| 7,850,102 | B2 | 12/2010 | Meier et al. | |
| 7,913,851 | B2 | 3/2011 | Chang | |
| 8,033,399 | B2 | 10/2011 | Pistorius | |
| 8,039,105 | B2 | 10/2011 | Meier et al. | |
| 8,231,007 | B2 | 7/2012 | Wark | |
| 8,322,646 | B2 | 12/2012 | Ueyama et al. | |
| 8,353,408 | B2 | 1/2013 | Ito | |
| 8,714,359 | B2 | 5/2014 | Aizawa | |
| 9,022,222 | B2 | 5/2015 | Devroe | |
| 9,333,699 | B2 | 5/2016 | Linkies | |
| 10,052,799 | B2 | 8/2018 | Bayer | |
| 10,252,298 | B2 | 4/2019 | Knauer et al. | |
| 2002/0086071 | A1 | 7/2002 | Rubhausen | |
| 2009/0104465 | A1 | 4/2009 | Yanagida | |
| 2010/0173031 | A1 | 7/2010 | Roberts et al. | |
| 2010/0320308 | A1 | 12/2010 | Ueyama | |
| 2011/0229722 | A1 | 9/2011 | Rivett | |
| 2014/0367882 | A1 | 12/2014 | Backmann et al. | |
| 2016/0257056 | A1 | 9/2016 | Schumacher et al. | |
| 2017/0036386 | A1 | 2/2017 | Planeta et al. | |
| 2020/0114564 | A1 | 4/2020 | Baier | |
| 2020/0180890 | A1 | 6/2020 | Durner | |
| 2021/0221043 | A1 | 7/2021 | Baier | |

FOREIGN PATENT DOCUMENTS

| | | | |
|---|---|---|---|
| CA | 2191630 | A1 | 6/1997 |
| CA | 3064404 | A1 | 6/2020 |
| CH | 537800 | | 6/1973 |
| CN | 65105162 | A | 12/1986 |
| CN | 1500712 | A | 6/2004 |
| CN | 101005936 | A | 7/2007 |
| CN | 201280352 | Y | 7/2009 |
| CN | 101987703 | A | 3/2011 |
| CN | 102083722 | A | 6/2011 |
| CN | 204 183 848 | U | 3/2015 |
| CN | 205634333 | A1 | 10/2016 |
| CN | 111302117 | A | 6/2020 |
| DE | 291871 | C | 5/1916 |
| DE | 22 50 151 | A1 | 5/1974 |
| DE | 2555848 | | 6/1977 |
| DE | 2919249 | A1 | 11/1979 |
| DE | 31 40 294 | A1 | 4/1983 |
| DE | 3140294 | A1 | 4/1983 |
| DE | 3338138 | A1 | 5/1985 |
| DE | 34 25 101 | A1 | 1/1986 |
| DE | 4100338 | A1 | 7/1992 |
| DE | 4140656 | C1 | 9/1992 |
| DE | 4116964 | A1 | 11/1992 |
| DE | 9214651 | U1 | 2/1993 |
| DE | 4428249 | A1 | 2/1995 |
| DE | 4405462 | C1 | 4/1995 |
| DE | 295 05 311 | U1 | 6/1995 |
| DE | 295 05 311 | | 7/1995 |
| DE | 19613902 | A1 | 10/1997 |
| DE | 197 28 382 | A1 | 1/1999 |
| DE | 19755357 | A1 | 6/1999 |
| DE | 198 40 344 | A1 | 5/2000 |
| DE | 19840344 | A1 | 5/2000 |
| DE | 10035894 | A1 | 4/2001 |
| DE | 10029175 | | 6/2001 |
| DE | 10059306 | C1 | 5/2002 |
| DE | 20117248 | U1 | 3/2003 |
| DE | 697 15 377 | T2 | 6/2003 |
| DE | 69715377 | T2 | 6/2003 |
| DE | 10 2004 040 151 | A1 | 3/2006 |
| DE | 10 2006 048 850 | A1 | 4/2008 |
| DE | 20 2008 012076 | U1 | 11/2008 |
| DE | 102009033171 | A1 | 1/2011 |
| DE | 10 2009 046 593 | A1 | 5/2011 |
| DE | 102009046585 | A1 | 5/2011 |
| DE | 102011085735 | A1 | 5/2013 |
| DE | 10 2013 016898 | A1 | 4/2015 |
| DE | 11 2015 001 615 | B4 | 4/2018 |
| DE | 102016012388 | A1 | 4/2018 |
| DE | 112015001615 | B4 | 4/2018 |
| DE | 102018009632 | A1 | 6/2020 |
| EP | 0139279 | A2 | 5/1985 |
| EP | 0 471 879 | A1 | 2/1992 |
| EP | 0471879 | A1 | 2/1992 |
| EP | 1947043 | A1 | 7/2008 |
| EP | 2261152 | A1 | 12/2010 |
| EP | 2639038 | A1 | 9/2013 |
| EP | 2873508 | A1 | 5/2015 |
| EP | 3266586 | A1 | 1/2018 |
| EP | 2326481 | B1 | 5/2018 |
| EP | 3686700 | A1 | 6/2020 |
| GB | 1331667 | A | 9/1973 |
| GB | 2 253 807 | A | 9/1992 |
| JP | S60 141229 | U | 9/1985 |
| JP | 161257 | | 6/1992 |
| JP | 15193 | | 2/1994 |
| JP | 2001080801 | A | 3/2001 |
| JP | 2009249178 | A | 10/2009 |
| JP | 2013245105 | A | 12/2013 |
| JP | 6918085 | B2 | 6/2021 |
| RU | 2060219 | C1 | 5/1996 |
| RU | 2 124 465 | C1 | 1/1999 |
| RU | 2128617 | C1 | 4/1999 |
| RU | 2737006 | C1 | 11/2020 |
| SU | 1615113 | A1 | 12/1990 |

(56) References Cited

FOREIGN PATENT DOCUMENTS

| | | | |
|---|---|---|---|
| TW | M504084 | U | 7/2015 |
| WO | 94/12290 | A1 | 6/1994 |
| WO | 2006/018293 | A1 | 2/2006 |

OTHER PUBLICATIONS

Search Report for German Application No. 10 2016 015 051.3, filed Dec. 16, 2016.
European Search Opinion for European Application No. 17 00 1985, filed Dec. 16, 2017, 15 pages (with machine language translation).
German Search Report for Application No. 10 2016 015 051.3, filed Dec. 16, 2016, 1 page.
European Search Report dated Apr. 26, 2018, for EP 17 00 1985, filed Dec. 16, 2017, 3 pages.
German Office Action dated Oct. 25, 2017 for Application No. 10 2016 015 051.3, 3 pages (with machine language translation).
Search Report for German Application No. 10 2018 008 127.4 dated Oct. 13, 2018.
Result of Examination Report for DE 10 2014 017 556.1 dated Nov. 28, 2014.
European Search Report and Search Opinion for EP15 00 3362 dated May 9, 2016.
Office Action for DE 10 2014 017 556.1 dated Jul. 7, 2015.
Chinese Search Report dated Oct. 12, 2019, for CN Appl. No. 201910965569.4 (with English trans.) (14 pages).
European Search Report dated Feb. 18, 2020 for EP 19 00 0457 (1 page).
German Search Results for Application No. 10 2018 008 127.4 filed Oct. 13, 2018 (1 page).
Response to Office Action dated Jan. 4, 2022 for U.S. Appl. No. 16/600,260.
Search Report dated Jun. 29, 2020, from Russian Patent Office for RU Appl. No. 2019140284 (with Eng translation).
Search Report from Taiwan Patent Office dated Oct. 24, 2020 for Application No. 108144774 (1 page).
Search Report from Chinese Patent Office for Application No. 20191262431.4, dated Dec. 11, 2019 (2 pages).
Search Report from Chihese Patent Office dated Dec. 17, 2020, for Application No. CN201911262431.4 (11 pages).

* cited by examiner

DEVICE FOR WINDING AND CHANGING THE REELS OF WEB MATERIAL AS WELL AS A DEDICATED PROCESS

FIELD OF THE INVENTION

The invention concerns a device for winding and changing the reels of web material, especially tubular film or film webs, which comprises a machine housing with rails for moving the winding shafts, two independently driven central drives to drive (rotate) the winding shafts, a drivable winding shaft guide unit which interacts with a central drive in each case and which moves the same on the rails between a parking position and a winding position, a contact roller unit which interacts with the winding shaft driven by the respective central drive in the winding position, slitting units to cut the web material, winding shaft transport units to feed new winding shafts for the winding shaft change and a reel removal unit as well as a dedicated process.

BACKGROUND

Winders are employed to wind web materials such as plastic film, paper webs, metal foil or textiles. The material webs to be wound come straight from the manufacturing process and are converted into reels to permit downstream processing.

Winders are also used for film, e.g. produced with blown film lines. Film tubes are formed at high speed in these processing lines and after being laid flat, must be wound onto reels without slowing down the production pace. The reel needs to be changed once it has attained a predefined size, this also happens without interrupting production of the continuous material web or changing the production speed. To this end, there are a number of different engineering possibilities and processes.

Among the known winding units are turret winders, contact winders and central winders.

In the case of a turret winder, a machine frame houses one or two pivoted turntables positioned opposite each other which can each accommodate at least two pivoted winding stations. In operation, the first winding station is in winding position and the second winding station is in a loading or unloading position in order to accommodate a new winding shaft or to remove a finished reel. Once the reel in winding position has attained its target size, the first and the second winding station change their respective position by rotating the turntable and the next reel can be wound. Disadvantageous here is that the assembly space needed in the case of large reel diameters is high.

An alternative to turret winders are winders with a linear movement of the winding stations, among these are the contact and central winders.

In the case of the contact winders, the reel to be wound is pressed against a driven contact roller; the reel itself is not separately driven. These winders need a so-called pre-winding station.

With the central winder, the reel is driven centrally in the winding station. It can not only be pressed against the contact roller but can also be operated with a clearance to the contact roller.

The disadvantage of the two last-named winders is that during a reel change, it is necessary to transfer the reel from the pre-winding station to the winding station. Besides this, the contact pressure of the reel against the contact roller is not defined, meaning that different winding conditions can develop.

Winders are designed for left-hand winding, right-hand winding or for both directions. The winding direction of the web material is dependent on the downstream process steps and also on which side of the film needs to be at the top for the next process step. As a result of the left-hand or right-hand winding, the pretreated side (corona pretreatment) which will be printed in a downstream process step is wound either on the inside or the outside. In addition, the location of the sealing layer in a coextrusion multilayer film during extrusion is independent of a required inside or outside location during winding. The winding shaft will rotate in the respective direction of rotation.

In German patent DE 44 28 249, a central winder is disclosed. The winder has two winding stations arranged in a winding frame which interact with a contact roller. The winding shafts of both winding stations are driven independently of each other in each case by motors. The winding stations are able to travel along the horizontal rails between the winding station and the removal station for the finished reels. The contact roller is motor-driven and can be lowered. During a winding station change-over, the contact roller is moved vertically downwards between the winding position and a parking position. The new winding shaft is inserted in idle state while the second winding shaft is in operation.

A disadvantage of this design is that the winding shaft bearing needs an additional drive. This type of central winder design requires a defined winding direction that is dependent on the requirements, and it is not possible to make a selection between right-hand and left-hand winding.

Film is differently structured, dependent on the number of layers and on what type of material the layers consist of. They do not need to be symmetric in their layer structure. Every film bubble has an inside and an outside surface. When winding, the objective is that dependent on the types of film layers and the type of downstream processing of the film, a certain side is either on the outside or the inside. To make this possible, it is important that the winder design permits both right-hand winding and left-hand winding.

SUMMARY

One aspect of the disclosure relates to a winder design that not only winds in both directions but which also requires no pre-winding station.

In any embodiment, the invention-design winder has a winding station located in a machine housing. This winding station has two central drives which operate in alternation.

The central drives are located one on each side in the machine housing. They interact with a drivable winding shaft guide. The respective central drive is connected to the driven winding shaft guide and is moved between a parking position and a winding position on rails. The central drives operate in alternation. The central drive that is currently in operation is connected to the drivable winding shaft guide, whereas the second central drive is stationary in its parking position.

In one invention design, the central drives are located on the outside of the machine frame and interact with the drivable winding shaft guide located on the inside, and in general, they move on horizontal rails, whereby horizontal rails are ideal and preferable.

In a preferred invention design, the winding shaft rests additionally on a support which is located parallel to and above the drivable winding shaft guide. The central drive is preferably in parking position at the machine housing or connected to a separate frame.

In winding position, a contact roller unit interacts with the winding shaft and the reel. The contact roller unit is designed to be movable, e.g. pneumatically or electrically. It can generally be moved horizontally between the winding position and a contact roller parking position. The contact roller unit comprises the contact roller, a guideway and the contact pressure control.

Alternatively, the reel can also be wound with a gap whereby then, the contact roller presses not against the reel but rather the film is routed over the contact roller.

Slitting units are located above and below the contact roller unit. They have two functions. On the one hand, they raise or lower the film web during a reel change in order to bring the new winding shaft into the winding start position, and on the other hand, they slit the film web open during the course of the winding shaft change. Cutting and lifting can also be realised in separate units so that above and below the contact roller unit, a lifting or lowering unit and a separate cutting unit are located in each case.

The device is also equipped with a winding shaft transport unit for the newly inserted winding shaft. It is essentially vertical in design and is positioned in the area between the drivable winding shaft guide and the contact roller unit. Dependent on the winding direction, the new winding shaft is conveyed from above or below by means of the winding shaft transport unit to the winding level above or below the film web.

If the reel is to be wound in the clockwise direction, the new winding shaft is moved from below to the winding level with the aid of the winding shaft transport unit.

If the reel is to be wound in the counterclockwise direction, the winding shaft is inserted from above into the winding shaft transport unit and is then lowered to the winding level together with the winding shaft transport unit.

In a preferred invention design, the new winding shafts can be transported by means of further winding shaft transport units to the initially mentioned winding shaft transport unit and then transferred to this so that the transport unit transports them towards the winding level.

Alternatively, the winding shafts are inserted sideways into the machine and are then placed in the winding shaft transport unit.

Another aspect of the disclosure relates to a process for winding and changing the reels.

With the invention-design process, a winding shaft is connected in operation to the first central drive and the drivable winding shaft guide. The central drive drives the winding shaft and the film web—which is routed by means of a contact roller to the winding shaft—is wound onto the winding shaft. The contact roller is pressed against the reel. To this end, the contact roller is designed to be movable. As the reel grows in diameter, it is driven by the central drive and the drivable winding shaft guide towards the reel removal unit and away from the contact roller. At the same time, the contact roller is pressed constantly against the reel to ensure that during winding, no air gets entrapped in the reel, the film does not deflect and so that at a defined contact pressure, a consistent reel quality can be guaranteed. The reel is wound until it reaches its target diameter.

Once the target diameter is reached, the reel change is prepared.

To start off, the winding shaft feed and the winding shaft change are described for the case of right-hand winding.

A new winding shaft is inserted in the winding shaft transport unit and is routed upwards to a first parking position upstream of the winding level.

The finished reel is driven by the first central drive and the drivable winding shaft guide towards the lowering arms of the reel removal unit.

This movement is carried out by drives at the drivable winding shaft guide. In the front position, the central drive disconnects from the drivable winding shaft guide and is then fixed in its final position, e.g. at the machine housing wall. The central drive continues to drive the reel onward. The contact roller unit moves somewhat to the rear, away from the winding position. The second central drive—which is located on the opposite side to the first central drive—now disconnects from its parking position and connects to the drivable winding shaft guide. The drivable winding shaft guide and the interconnected second central drive now move towards the contact roller unit to the winding position.

The winding position is not a fixed location but is rather that position in which the central drive in interaction with the contact roller winds the web material onto the reel. As the reel diameter increases, the position shifts on the rails further and further towards the reel removal unit.

The new winding shaft is now transported by means of the winding shaft transport unit from the first parking position upwards towards the winding level into a second parking position. The bottom slitting unit is swivelled into the film path acting as a lifting unit, and the film web is raised in order to create space for the new winding shaft. The drivable winding shaft guide shifts along with the second central drive into a start winding position. The new winding shaft is moved from the second parking position further upwards into the winding start position. The winding shaft now connects with the second central drive and the drivable winding shaft guide and is shifted into the winding position. The second central drive now drives the reel.

The support for the winding shaft of the winding shaft transport unit is lowered, the contact roller unit travels to the winding shaft, the bottom slitting unit swivels into the cutting position and the film is cut through. Dependent on the design, these steps take place within a short period of time or even simultaneously.

The film is now wound by the second central drive onto the new winding shaft.

The remaining web material is wound onto the finished reel by the first central drive. The first central drive is disconnected from the finished reel and the finished reel is removed from the winder by means of the reel removal device. The reel removal device can be in hydraulic design.

In the following description, the winding shaft feed and the winding shaft change are described for the case of left-hand winding.

A new winding shaft is inserted into the winding shaft transport unit at the top and travels to a first parking position above the winding level. The finished reel is driven together with the central drive and the drivable winding shaft guide towards the reel removal unit, is deposited in front of the lowering arms of the reel removal unit and the first central drive disconnects itself from the drivable winding shaft guide and connects into its parking position while winding further. The new winding shaft is moved into a somewhat lower parking position above the winding level. The contact roller moves from its winding position to the rear. The top slitting unit swivels downwards and presses the web material downwards. The second central drive disconnects from its parking position and connects to the drivable winding shaft guide and travels towards the winding position. The new winding shaft now has sufficient space and is driven into the winding start position. The winding shaft is connected to the second central drive and the drivable winding shaft guide. The central drive drives the winding shaft. The drivable winding shaft guide and the second central drive as well as the new winding shaft now move into the winding position.

The support for the winding shaft of the winding shaft transport unit is lowered. The top slitting unit returns to its top parking position, the contact roller moves up to the new winding shaft. The bottom slitting unit swivels into the film path and the web material is cut through. Dependent on the design, these steps take place within a short period of time or even simultaneously.

The new reel is wound and the finished reel is removed from the winder by the reel removal device.

The functions "Raise" or "Press" and "Cut" of the slitting units can also be realised with separate devices, both for left-hand and right-hand winding.

Alternatively, the winder can also be designed for gap winding, which does away with the necessity of pressing the contact roller against the reel.

Such a winder makes continuous winding possible without the winding conditions changing as the result of undesirable outside disturbances. The web material is wound right from the start under defined conditions such as web tension and contact pressure, and is not affected by external influences as commonly occur at pre-winding stations when the reel is transferred from the pre-winding station to the winding station. The reel has a stable core and differences between the different winding layers do not occur simply because there is no pre-winding station. Furthermore, both left-hand and right-hand winding are possible with the winder.

Other details, features and advantages of the subject matter of the invention are also disclosed.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION

Figure 1:
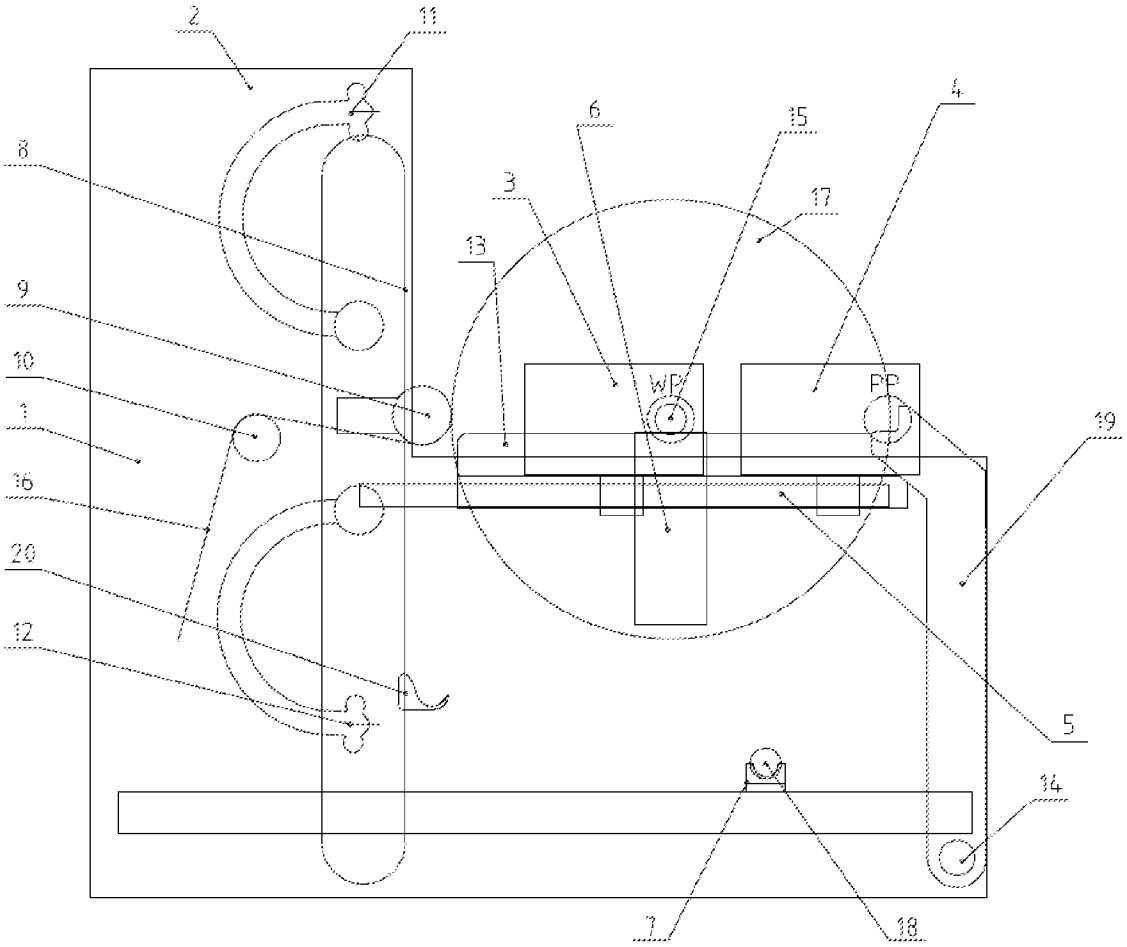
FIG. 1: shows a side view of the invention-design winder.

In FIG. 1, a preferred embodiment of the invention-design winder (1) for winding film webs—especially tubular film—and for changing the film reels is shown.

The winder (1) has a machine housing (2). In one section of the winder (1) are on each side of the outside of the machine housing (2) a first central drive (3) and a second central drive (4) located on rails (5). On the same level on the inside of the machine housing (2) is a driven winding shaft guide (6). It interacts together with the central drives (3) or (4) and travels on the horizontal rails (5) forwards and backwards. The central drives (3) and (4) are connected to the winding shafts.

On one side of the rails (5)—on the right-hand side of FIG. 1—is a reel removal device (14), whereas on the other side of the rails (5)—on the left-hand side of FIG. 1—is a vertical winding shaft transport unit (8) and a contact roller unit (9). Above and parallel to the rails (5) is a support (13) for the winding shafts.

Below this subassembly is a horizontal winding shaft transport unit (7) which connects to the new winding shafts and transports them below the drivable winding shaft guide (6) towards a second vertical winding shaft transport unit (8) which transports them upwards towards the winding position. The vertical winding shaft transport unit (8) can also take up new winding shafts from above and transport them downwards towards the winding position if the reel is to be wound in the opposite winding direction.

A contact roller unit (9) is located in a second section of the machine housing (2) (left in FIG. 1) on the same level as the rails (5). It interacts with the winding shaft (15) and the reel (17) being generated. In this case, for example, its actuation is pneumatic. A deflection roller (10) is located downstream. Below and above the contact roller unit (9) or the winding level is a slitting device (11, 12) in each case. They have the function of raising, lowering or cutting the film web.

The hydraulic reel removal device (14) is located at the end of the rails (5) (on the right in FIG. 1) on the opposite side of the machine frame (2) which accommodates the contact roller unit (9).

Using FIG. 1 by way of explanation, the winding of a film web is described. The winding shaft (15) is connected to a first central drive (3) located at the outside wall of the machine housing (2) and to the driven winding shaft guide (6) located on the inside of the machine housing (2). This first central drive (3) winds the film web (16) in the winding position (WP), the film web being routed via the deflection roller (10) into the winder (1). The contact roller unit (9) thereby presses against the winding shaft (15) or the reel (17). As the diameter of the reel (17) increases, it moves together with the drivable winding shaft guide (6) and the first central drive (3) towards the reel removal unit (14). The winding shaft thereby lies flush on a support (13) located on both sides of the machine housing (2).

Once the reel (17) has reached its target diameter, the reel change is prepared.

Figure 2:
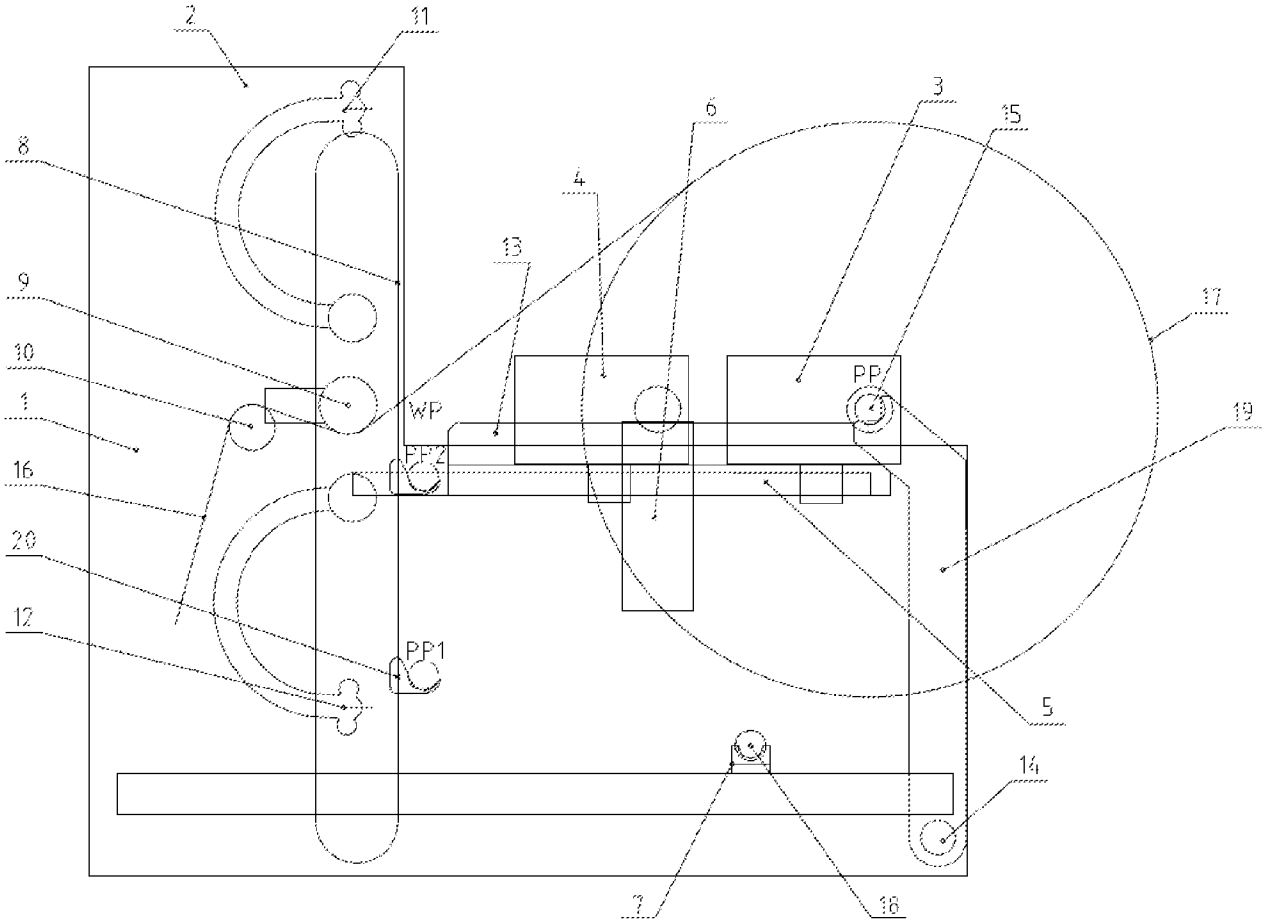
FIG. 2: shows a side view of the winder during a reel change for the case of right-hand winding.

Using FIG. 2 by way of explanation, the reel change for right-hand winding is described. To this end, a new winding shaft (18) is inserted into the horizontal winding shaft transport unit (7) located at the bottom and is transported towards the vertical winding shaft transport unit (8), is transferred to same and is then moved upwards into parking position 1 (PP1). The first central drive (3) and the drivable winding shaft guide (6) move the finished reel (17) towards the lowering arms (19) of the reel removal unit (14). The second central drive (4) is in its parking position (PP) (not shown here).

The contact roller unit (9) is now shifted horizontally away from the reel (17) (to the left in FIG. 2) and its winding position. The new winding shaft (18) is moved from parking position 1 (PP1) further upwards into the parking position 2 (PP2). The first central drive (3) of the finished reel (17) disconnects from the drivable winding shaft guide (6) and connects to its parking position PP on the outside of the machine housing wall (2), at the same time continuing to rotate the reel (17). Some of these steps take place simultaneously. The second central drive (4) disconnects from its parking position (PP) at the machine housing wall (2) and connects up to the drivable winding shaft guide (6) and travels towards the contact roller unit into a winding start position (cf. FIG. 1). The bottom slitting device (12) is swivelled into the film web (16) and raises it so that the new winding shaft (18) can be moved from the parking position 2 (PP2) into the winding start position. The drivable winding shaft guide (6) now moves with the second central drive (4)

into the winding start position in which the new winding shaft (18) is located, and the second central drive (4) connects up to the winding shaft (18) and actuates it.

The hook (20) of the vertical winding shaft transport unit moves downwards. The drivable winding shaft guide and the second central drive as well as the winding shaft now move into the winding position (WP). The bottom slitting device (12) swivels into the cutting position. The contact roller unit (9) moves up to the new winding shaft (18). The film web (16) is cut and the bottom slitting device (12) swivels back. The new reel is generated. These steps take place within a short period of time or even simultaneously.

The finished reel (17) can now be removed from the winder (1) by the reel removal device (14).

Figure 3:
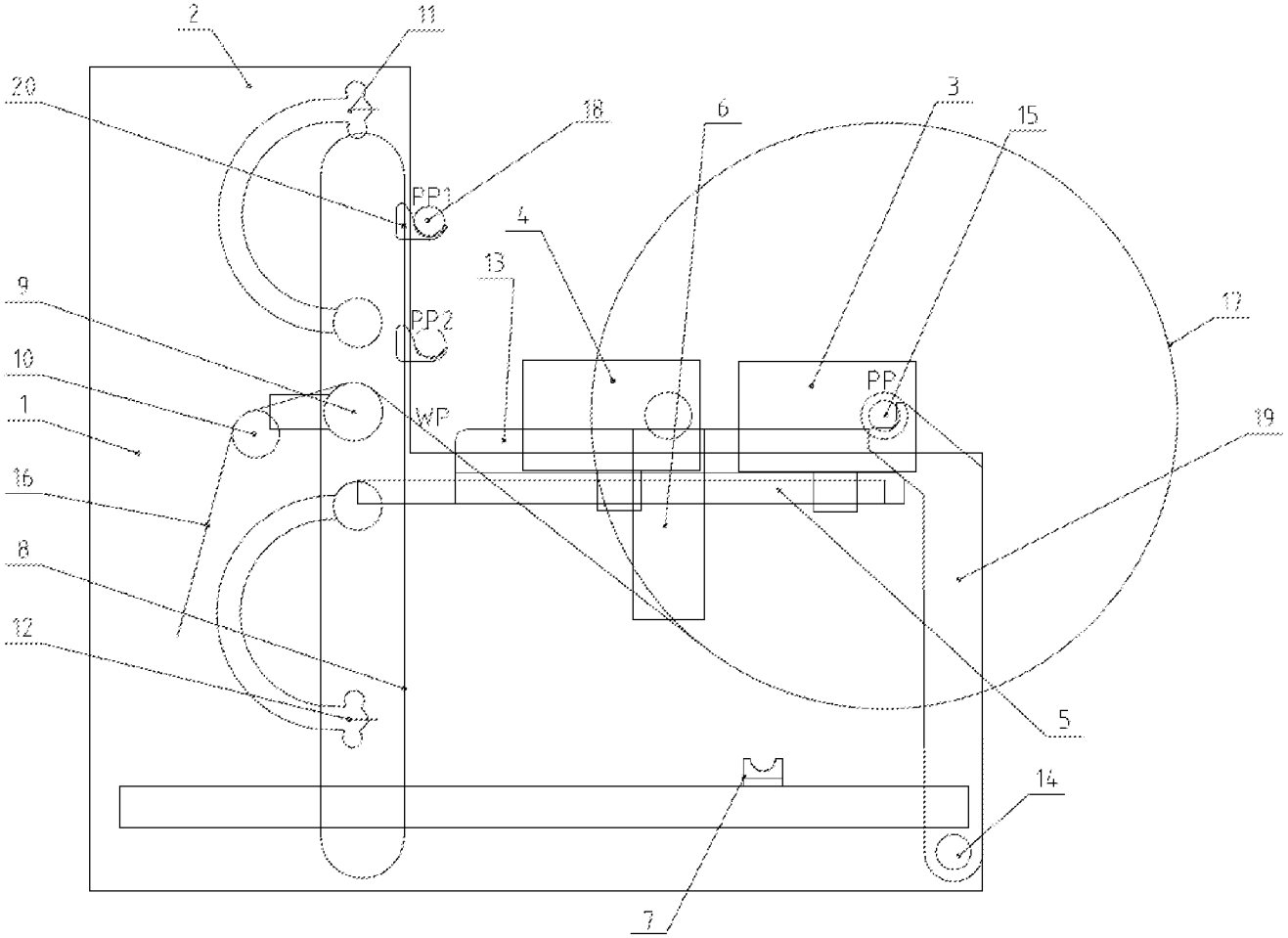
FIG. 3: shows a side view of the winder during a reel change for the case of left-hand winding.

The reel change for left-hand winding is now described with the help of FIG. 3. It is assumed that the reel (17) currently being wound in the winder (1) is being wound with the first central drive (3).

For the left-hand winding of film webs, the new winding shaft (18) is inserted from above into the vertical winding shaft transport unit (8) and is driven into parking position 1 (PP1) above the winding level. The first central drive (3) and the drivable winding shaft guide (6) move the finished reel (17) to the lowering arms (19) of the reel removal unit (14). The second central drive (4) is in its parking position PP. The contact roller unit (9) is now shifted away from the reel (17) (to the left in FIG. 1) and out of its winding position. The new winding shaft (18) is moved from parking position 1 (PP1) further towards the winding level into its parking position 2 (PP2). The first central drive (3) of the finished reel (17) disconnects from the drivable winding shaft guide (6) and connects up to its parking position (PP) at the outside of the machine housing wall (2). Some of these steps take place simultaneously. The second central drive (4) on the opposite side disconnects from its parking position (PP) at the machine housing wall (2) and connects up to the drivable winding shaft guide (6), and both are shifted towards the contact roller unit (9) into the winding start position (cf. FIG. 3). The top slitting device (11) is swivelled into the film web (16) and presses the film web (16) downwards so that the new winding shaft (18) can be moved from parking position 2 (PP2) into the winding start position. The drivable winding shaft guide (6) now moves with the second central drive (4) into the winding start position in which the new winding shaft (18) is located, and the second central drive (4) connects up to the winding shaft (18) and actuates it.

The hook (20) of the vertical winding shaft transport unit (8) moves downwards. The drivable winding shaft guide, the second central drive as well as the new winding shaft now move into the winding position (WP). The top slitting device (11) swivels back. The bottom slitting device (12) swivels upwards into the cutting position. The contact roller unit (9) moves up to the new winding shaft (18). The film web (16) is cut and the bottom slitting device (12) swivels back. These steps take place within a short period of time or even simultaneously.

The new reel is generated. The finished reel (17) can now be removed from the winder (1) by the reel removal device (14).

LEGEND

1 Winder
2 Machine housing
3, 4 Central drives
5 Rails
6 Drivable winding shaft guide
7 Horizontal winding shaft transport unit
8 Vertical winding shaft transport unit
9 Contact roller unit
10 Deflection roller
11, 12 Lifting and cutting device
13 Support
14 Hydraulic reel removal device
15 Winding shaft
16 Film web/web material
17 Reel
18 New winding shaft
19 Lowering arms
20 Hook
PP Parking position
PP 1 Parking position 1
PP 2 Parking position 2
WP Winding position

The invention claimed is:

1. A device for winding and changing reels of a web material, the device comprising a machine housing with rails, first and second central drives, the first and second central drives independently operable to drive a winding shaft, a drivable winding shaft guide which travels on the rails and interacts in each case with one of the first and second central drives and which drives these on the rails between a parking position and a winding position, a contact roller unit which interacts with the winding shaft in the winding position driven by the respective central drive, slitting units to cut through the web material, winding shaft transport units to feed a new winding shaft for a winding shaft change, and a reel removal device, wherein for a winding shaft change, the drivable winding shaft guide together with the first central drive, which drives a finished reel onto the winding shaft, is drivable from the winding position into the parking position, wherein the first central drive is disconnectable from the drivable winding shaft guide and connected to the parking position, wherein the second central drive is connectable to the drivable winding shaft guide and is drivable driven from the parking position into the winding position where the second central drive is connectable to the new winding shaft and is drivable, wherein the contact roller unit is drivable towards the new winding shaft and interacts with the new winding shaft, and wherein the web material is cut off by the slitting device and can be wound up to a new reel.

2. The device of claim 1, wherein the new winding shaft can be transported from below for right-hand winding of the web material by one of the winding shaft transport units into the winding position.

3. The device of claim 1, wherein the new winding shaft can be transported from above for left-hand winding of the web material by one of the winding shaft transport units into the winding position.

4. The device of claim 1, wherein the slitting units are located above and below the winding position of the winding shaft and are able to raise, lower and cut the web material.

5. The device of claim 4, wherein in the case of right-hand winding, the web material can be raised and cut through by the bottom slitting unit.

6. The device of claim 4, wherein in the case of left-hand winding, the web material can be pressed downwards by the top slitting unit and can then be cut through by the bottom slitting unit.

7. The device of claim 1, wherein the web material constitutes film webs, composite film webs or tubular film.

8. A method for winding and changing the reels of web material, the method comprising:

winding the web material onto a first winding shaft which is driven by a first central drive, whereby the first central drive interacts with a driven winding shaft guide, whereby for winding a reel, the winding shaft interacts with a contact roller unit (9), and changing the reels of the web material, wherein changing the reels comprises:

a finished reel, which is driven by the first central drive, is shifted by the drivable winding shaft guide from a winding position into a parking position, disconnecting the first central drive from the drivable winding shaft guide and connecting in the parking position, whereby the central drive continues to rotate the reel, connecting the drivable winding shaft guide with a second central drive and shifting the second central drive from the parking position into the winding position, connecting the second central drive with a new winding shaft and actuating the new winding shaft, shifting the contact roller unit towards the new winding shaft, cutting the web material with slitting units and winding a new reel, and removing the new reel by means of a reel removal system.

9. The method of claim 8, wherein the new winding shaft is transported from below for right-hand winding of the web material by a winding shaft transport unit into the winding position.

10. The method of claim 8, wherein the new winding shaft is transported from above for left-hand winding of the web material by a winding shaft transport unit into the winding position.

11. The method of claim 8, wherein for left-hand winding of the web material, one of the slitting units is located above the winding position and swivels into the web material and presses the web material downwards, the winding shaft is moved into the winding position, the contact roller unit is moved into the winding position and the top slitting device swivels back, then a bottom slitting device swivels into the web material and cuts through the web.

12. The method of claim 8, wherein for right-hand winding of the web material, one of the slitting units is located underneath the winding position and swivels into the web material and raises the web material, the winding shaft is moved into the winding position, the contact roller unit is moved into the winding position and a bottom slitting device swivels into a cutting position and cuts through the web.

13. The method of claim 8, wherein the web material constitutes film webs, composite film webs or tubular film.

* * * * *